United States Patent [19]

Otsuka et al.

[11] 4,393,843

[45] Jul. 19, 1983

[54] AIR-FUEL RATIO FEEDBACK CONTROL SYSTEM FOR INTERNAL COMBUSTION ENGINES, HAVING FUNCTION OF CORRECTING POSITION OF AIR/FUEL RATIO CONTROL VALVE ACTUATOR

[75] Inventors: Kazuo Otsuka, Higashikurume; Shin Narasaka, Yono; Shumpei Hasegawa, Niiza, all of Japan

[73] Assignee: Honda Motor Co., Ltd., Tokyo, Japan

[21] Appl. No.: 288,528

[22] Filed: Jul. 30, 1981

[30] Foreign Application Priority Data

Aug. 7, 1980 [JP] Japan ..... 55-108507

[51] Int. Cl.[3] ..... F02M 7/18

[52] U.S. Cl. ..... 123/440; 123/589

[58] Field of Search ..... 123/440, 489, 585, 589, 123/339, 361

[56] References Cited

U.S. PATENT DOCUMENTS

| | | | |
|---|---|---|---|
| 4,083,337 | 4/1978 | Hattori et al. | 123/589 |
| 4,106,451 | 8/1978 | Hattori et al. | 123/589 X |
| 4,192,268 | 3/1980 | Hattori et al. | 123/589 |
| 4,337,742 | 7/1982 | Carlson et al. | 123/585 X |

*Primary Examiner*—Tony M. Argenbright

*Attorney, Agent, or Firm*—Arthur L. Lessler

[57] ABSTRACT

An air/fuel ratio feedback control system for internal combustion engines, which is arranged such that when a pulse motor for driving an air/fuel ratio control valve passes the switching point of position detecting means during feedback control operation, a value indicative of the number of steps corresponding to the reference position of the pulse motor, stored in a memory in an electrical circuit for driving the pulse motor is simultaneously shifted to an actual position counter. Air/fuel ratio control can be achieved with accuracy on the basis of a count in the above actual position counter which thus exactly corresponds to the actual position of the pulse motor.

2 Claims, 4 Drawing Figures

AIR-FUEL RATIO FEEDBACK CONTROL SYSTEM FOR INTERNAL COMBUSTION ENGINES, HAVING FUNCTION OF CORRECTING POSITION OF AIR/FUEL RATIO CONTROL VALVE ACTUATOR

BACKGROUND OF THE INVENTION

This invention relates to an air/fuel ratio feedback control system for performing feedback control of the air/fuel ratio of an air/fuel mixture being supplied to an internal combustion engine, and more particularly to an arrangement which is capable of monitoring with accuracy the position of an actuator for driving an air/fuel ratio control valve to thereby ensure achievement of highly accurate air/fuel ratio control.

An air/fuel ratio feedback control system for performing feedback control of the air/fuel ratio of an air/fuel mixture being supplied to an internal combustion engine, has already been proposed by the assignee of the present application, which comprises means for detecting the concentration of an exhaust gas ingredient emitted from the engine, fuel quantity adjusting means for producing the mixture being supplied to the engine, and means operatively connecting the concentration detecting means with the fuel quantity adjusting means in a manner effecting feedback control operation to control the air/fuel ratio of the mixture to a predetermined value in response to an output signal produced by the concentration detecting means, the connecting means including an electrical circuit, an air/fuel ratio control valve, and a pulse motor arranged to be controlled by the electrical circuit to drive the air/fuel ratio control valve.

In this proposed air/fuel ratio feedback control system, a reed switch is provided which is adapted to be opened or closed when a pulse motor, which is used as an actuator for driving an air/fuel ratio control valve, passes a predetermined position set as a reference position for the pulse motor. This predetermined position, which thus corresponds to the switching point of the reed switch, is previously stored in a memory in the electrical circuit of the connecting means. At the start of the engine, reaching of the pulse motor to the above predetermined reference position during driving of the same is detected on the basis of turning-on or -off of the reed switch to determine the initial position of the pulse motor. Air/fuel ratio control operation following the start of the engine is carried out with the value stored in the memory in the electrical circuit regarded as the reference position of the pulse motor.

According to this proposed air/fuel ratio feedback control system arranged above, the pulse motor per se does not produce any signal indicative of its actual position. Instead, the actual position of the pulse motor is monitored in an indirect manner such that the count in the actual position counter which counts pulses supplied from means in the electrical circuit for supplying driving pulses to the pulse motor is regarded as the actual position of the pulse motor. Thus, the actual position of the pulse motor is not directly monitored.

However, there can occur a disagreement between the count of the actual position counter and the actual position of the pulse motor due to skipping or racing of the pulse motor. As a consequence, it is impossible to control the air/fuel ratio of a mixture being supplied to the engine to proper values during open loop control where the actual position of the pulse motor has to be exactly known by the electrical circuit.

OBJECT AND SUMMARY OF THE INVENTION

It is therefore the object of the invention to provide an air/fuel ratio feedback control system which is arranged such that simultaneously when the pulse motor passes the switching point of the reed switch during feedback control operation, a value indicative of the number of steps corresponding to the reference position of the pulse motor and stored in the memory in the electrical circuit is shifted to the actual position counter to keep the actual position of the pulse motor grasped by the electrical circuit, to thereby ensure achievement of proper air/fuel ratios during open loop control in particular.

According to the invention, there is provided an air/fuel ratio feedback control system for performing feedback control of the air/fuel ratio of an air/fuel mixture being supplied to an internal combustion engine, which includes means for detecting the concentration of an exhaust gas ingredient emitted from the engine, fuel quantity adjusting means for producing the mixture being supplied to the engine, means operatively connecting the concentration detecting means with the fuel quantity adjusting means in a manner effecting feedback control operation to control the air/fuel ratio of the mixture to a predetermined value, the connecting means comprising an electrical circuit, valve means for varying the air/fuel ratio of the mixture, and a pulse motor arranged to be controlled by the electrical circuit for driving the valve means. The system is characterized by comprising in combination position detecting means for producing an output when the pulse motor is at a predetermined reference position which is set within a maximum allowable position range of the pulse motor, a memory storing a value indicative of the predetermined reference position for the pulse motor, a first register responsive to an output signal of the concentration detecting means, indicative of the concentration of the exhaust gas ingredient, to make accessible a predetermined desired value for the pulse motor, a second register storing a value indicative of an actual position of the pulse motor, means for driving the pulse motor until the actual position value in the second register becomes equal to the predetermined desired value, and means responsive to the output of the position detecting means to cause shifting of the predetermined reference position value stored in the memory of the second register to replace the value stored in the latter by the predetermined reference position value.

The above and other objects, features and advantages of the invention will be more apparent from the ensuing detailed description taken in connection with the accompanying drawings in which:

DETAILED DESCRIPTION

Details of the air/fuel ratio feedback control system according to the invention will now be described by reference to the accompanying drawings wherein an embodiment of the invention is illustrated.

Figure 1:
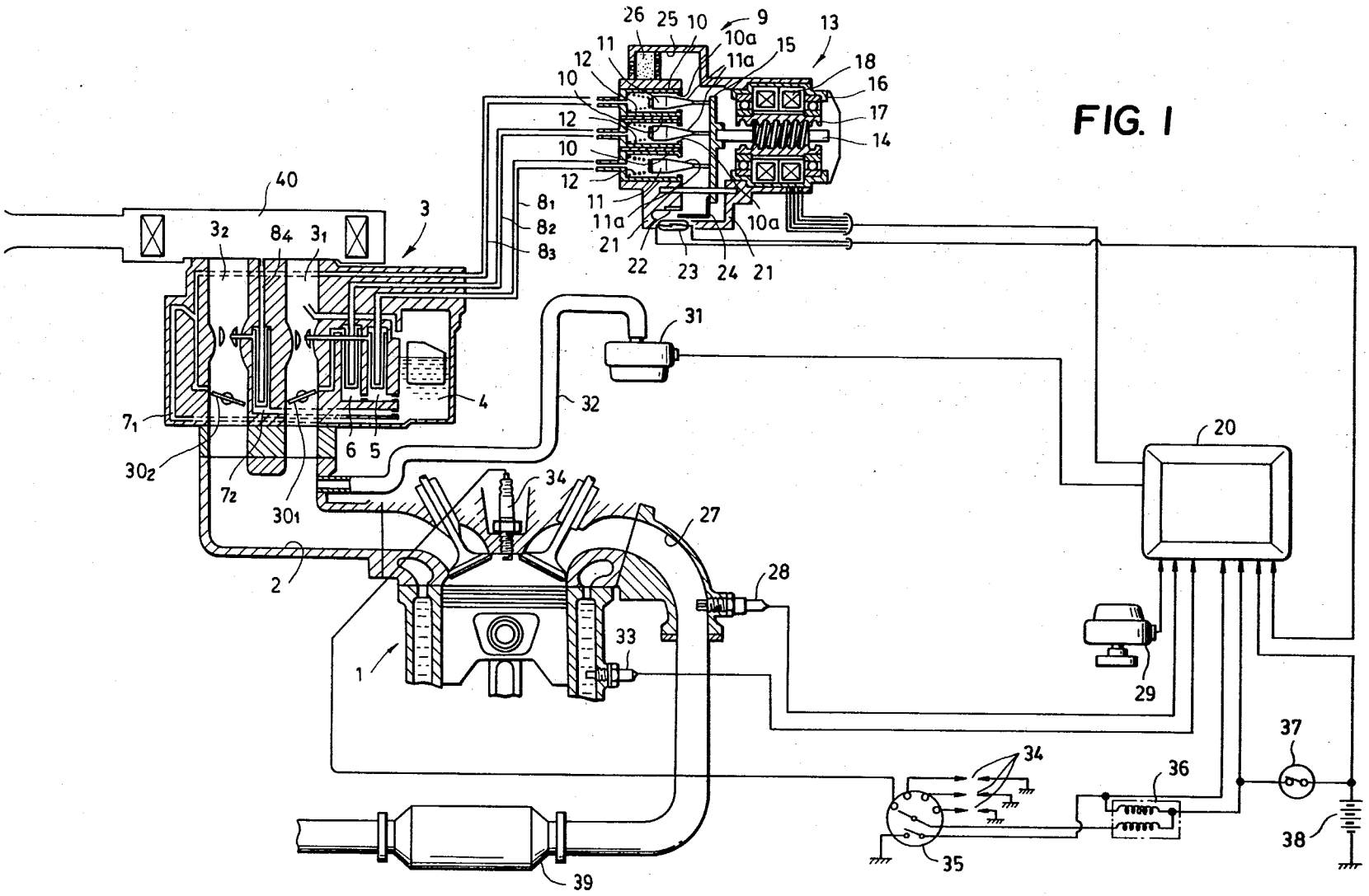
FIG. 1 is a diagrammatic view illustrating the arrangement of an air/fuel ratio feedback control system according to the present invention.

Referring first to FIG. 1, there is illustrated the whole system of the invention. Reference numeral 1 designates an internal combustion engine. Connected to the engine 1 is an intake manifold 2 which is provided with a carburetor generally designated by the numeral 3. The carburetor 3 has fuel passages 5, 6 which communicate a float chamber 4 with the primary bore $3_1$ of the carburetor 3. These fuel passages 5, 6 are connected to an air/fuel ratio control valve generally designated by the numeral 9, via air bleed passages $8_1$, $8_2$. The carburetor 3 also has fuel passages $7_1$, $7_2$ communicating the float chamber 4 with the secondary bore $3_2$ of the carburetor 3. The fuel passage $7_1$, on one hand, is connected to the above air/fuel ratio control valve 9 via an air passage $8_3$ and, on the other hand, opens in the secondary bore $3_2$ at a location slightly upstream of a throttle valve $30_2$ in the secondary bore. The fuel passage $7_2$ communicates with the interior of an air cleaner 40 via an air passage $8_4$ having a fixed orifice. The control valve 9 is comprised of three flow rate control valves, each of which is formed of a cylinder 10, a valve body 11 displaceably inserted into the cylinder 10, and a coil spring 12 interposed between the cylinder 10 and the valve body 11 for urging the valve body 11 in a predetermined direction. Each valve body 11 is tapered along its end portion 11*a* remote from the coil spring 12 so that the effective opening area of the opening 10*a* of each cylinder 10, in which the tapered portion 11*a* of the valve body is inserted, varies as the valve body 11 is moved. Each valve body 11 is disposed in urging contact with a connection plate 15 coupled to a worm element 14 which is axially movable but not rotatable about its own axis. The worm element 14 is in threaded engagement with the rotor 17 of a pulse motor 13 which is arranged about the element 14 and rotatably supported by radial bearings 16. Arranged about the rotor 17 is a solenoid 18 which is electrically connected to an electronic control unit (hereinafter called "ECU") 20. The solenoid 18 is energized by driving pulses supplied from ECU 20 to cause rotation of the rotor 17 which in turn causes movement of the worm element 14 threadedly engaging the rotor 17 in the leftward and rightward directions as viewed in FIG. 1. Accordingly, the connection plate 15 coupled to the worm element 14 is moved leftward and rightward in unison with the movement of the worm element 14.

The pulse motor 13 has its stationary housing 21 provided with a permanent magnet 22 and a reed switch 23 arranged opposite to each other. The plate 15 is provided at its peripheral edge with a magnetic shielding plate 24 formed of a magnetic material which is interposed between the permanent magnet 22 and the reed switch 23 for movement into and out of the gap between the two members 22, 23. The magnetic shielding plate 24 is displaced in the leftward and rightward directions in unison with displacement of the plate 15 in the corresponding directions. The reed switch 23 turns on or off in response to the displacement of the plate 24. That is, when the valve body 11 of the air/fuel ratio control valve 9 passes a reference position which is determined by the positions of the permanent magnet 22, reed switch 23 and magnetic shielding plate 24, the reed switch 23 turns on or off depending upon the moving direction of the valve body 11, to supply a corresponding binary output signal to ECU 20.

Incidentally, the pulse motor housing 21 is formed with an air intake 25 communicating with the atmosphere. Air is introduced through a filter 26 mounted in the air intake 25, into each flow rate control valve in the housing 21.

On the other hand, an $O_2$ sensor 28, which is made of zirconium oxide or the like, is inserted in the inner peripheral wall of the exhaust manifold 27 of the engine 1 in a manner partly projecting in the manifold 27. The sensor 28 is connected to ECU 20 to supply its output thereto. An atmospheric pressure sensor 29 is provided to detect the ambient atmospheric pressure surrounding the vehicle, not shown, in which the engine 1 is installed. The sensor 29 is also connected to ECU 20 to supply its output thereto.

Incidentally, in FIG. 1, reference numeral 39 designates a three-way catalyst for purifying CO, HC and NOx present in the engine exhaust gases, 31 a pressure sensor arranged to detect the absolute pressure in the intake manifold 2 at a zone downstream of the throttle valves $30_1$, $30_2$ through a conduit 32, the sensor 31 being connected to ECU 20 to supply its output thereto, and 33 a thermistor partly inserted in the peripheral wall of the engine 1, the interior of which is filled with engine cooling water, to detect the temperature of the cooling water as an engine temperature, the sensor 33 being also connected to ECU 20 to supply its output thereto, respectively. Reference numeral 34 denotes an ignition plug embedded in the cylinder head of the engine 1 with its tip projected in the combustion chamber, 35 a distributor, 36 an ignition coil, 37 an ignition switch and 38 a battery, respectively. The distributor 35 has a drive shaft, not shown, arranged to be rotated at speeds proportional to the engine rpm so that the ignition coil 36 produces pulses corresponding in frequency to switching of the contact point of the distributor 35 or an output signal produced by a contactless pickup alteratively provided. The ignition coil 36 is connected to ECU 20 to supply its output pulses thereto. Thus, the distributor 35 and the ignition coil 36 also serve as an engine rpm sensor in the illustrated embodiment.

Details of the air/fuel ratio control which can be performed by the air/fuel ratio feedback control system of the invention described above will now be described with reference to FIG. 1 which has been referred to hereinabove.

Initialization

Referring first to the initialization, when the ignition switch 37 in FIG. 1 is set on at the start of the engine, ECU 20 is initialized to detect the reference position of the actuator or pulse motor 13 by means of the reed switch 23 and hence drive the pulse motor 13 to set it to its best position (a preset position) for starting the engine, that is, set the initial air/fuel ratio to a predetermined proper value. The above preset position of the pulse motor 13 is hereinafter called "$PS_{CR}$". This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idling rpm.

The above reference position of the pulse motor 13 is detected as the position at which the reed switch 23 turns on or off, as previously mentioned with reference to FIG. 1.

Then, ECU 20 monitors the condition of activation of the $O_2$ sensor 28 and the coolant temperature Tw detected by the thermistor 33 to determine whether or not the engine is in a condition for initiation of the air/fuel ratio control. For accurate air/fuel ratio feedback control, it is a requisite that the $O_2$ sensor 28 is fully activated and the engine is in a warmed-up condition. The $O_2$ sensor 28, which is made of stabilized zirconium dioxide or the like, has a characteristic that its internal resistance decreases as its temperature increases. If the $O_2$ sensor is supplied with electric current through a resistance having a suitable resistance value from a constant-voltage regulated power supply provided within ECU 20, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions are fulfilled that the sensor produces an activation signal when its output voltage lowers down to a predetermined voltage Vx, a timer finishes counting for a predetermined period of time $t_x$ (e.g., 1 minute) starting from the occurrence of the above activation signal, and the coolant temperature Tw increases up to a predetermined value Twx at which the automatic choke is opened to an opening for enabling the air/fuel ratio feedback control.

During the above stage of the detection of activation of the $O_2$ sensor and the coolant temperature Tw, the pulse motor 13 is held at its predetermined position $PS_{CR}$. The pulse motor 13 is driven to appropriate positions in response to the operating condition of the engine after initiation of the air/fuel ratio control, as hereinlater described.

Basic Air/Fuel Ratio Control

Following the initialization, the program proceeds to the basic air/fuel ratio control.

ECU 20 is responsive to various detected value signals representing the output voltage of the $O_2$ sensor 28, the absolute pressure in the intake manifold 2 detected by the pressure sensor 31, the engine rpm Ne detected by the rpm sensor 35, 36, and the atmospheric pressure $P_A$ detected by the atmospheric pressure sensor 29, to drive the pulse motor 13 as a function of these signals to control the air/fuel ratio. More specifically, the basic air/fuel ratio control comprises open loop control which is carried out at wide-open-throttle, at engine idle, and at engine deceleration, and closed loop control which is carried out at engine partial load. All the control is initiated after completion of the warming-up of the engine.

First, the condition of open loop control at wide-open-throttle is met when the differential pressure $P_A$-$P_B$ (gauge pressure) between the absolute pressure $P_B$ detected by the pressure sensor 31 and the atmospheric pressure $P_A$ (absolute pressure) detected by the atmospheric pressure sensor 29 is lower than a predetermined value $\Delta P_{WOT}$. ECU 20 compares the difference in value between the output signals of the sensors 29, 31 with the predetermined value $\Delta P_{WOT}$ stored therein, and when the relationship of $P_A-P_B<\Delta P_{WOT}$ stands, drives the pulse motor 13 to a predetermined position (preset position) $PS_{WOT}$ and holds it there, which is a position best appropriate for the engine emissions to be obtained at the time of termination of the wide-open-throttle open loop control. At wide-open-throttle, a known economizer, not shown, or the like is actuated to supply a rich or small air/fuel ratio mixture to the engine.

The condition of open loop control at engine idle is met when the engine rpm Ne is lower than a predetermined idle rpm $N_{IDL}$ (e.g., 1,000 rpm). ECU 20 compares the output signal value Ne of the rpm sensor 35, 36 with the predetermined rpm $N_{IDL}$ stored therein, and when the relationship of $Ne<N_{IDL}$ stands, drives the pulse motor 13 to a predetermined idle position (preset position) $PS_{IDL}$ which is best suitable for the engine emissions and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold is lower than a predetermined value $PB_{DEC}$. ECU 20 compares the output signal value $P_B$ of the pressure sensor 31 with the predetermined value $PB_{DEC}$ stored therein, and when the relationship of $P_B<PB_{DEC}$ stands, drives the pulse motor 13 to a predetermined deceleration position (preset position) $PS_{DEC}$ best suitable for the engine emissions and holds it there.

The ground for this condition of open loop control at engine deceleration lies in that when the absolute pressure $P_B$ in the intake manifold drops below the predetermined value, unburned HC is produced at an increased rate in the exhaust gases, to make it impossible to carry out the air/fuel ratio feedback control based upon the detected value signal of the $O_2$ sensor with accuracy, thus failing to control the air/fuel ratio to a theoretical value. Therefore, according to the invention, the open loop control is employed, as noted above, when the absolute pressure $P_B$ in the intake manifold detected by the pressure sensor 31 is smaller than the predetermined value $PB_{DEC}$, where the pulse motor is set to the predetermined position $PS_{DEC}$ best suitable for the engine emissions obtained at the time of termination of the deceleration open loop control. At the beginning of engine deceleration, a shot air valve, not shown, is actuated to supply air into the intake manifold to prevent the occurrence of unburned ingredients in the exhaust gases.

During operations of the above-mentioned open loop control at wide-open-throttle, at engine idle, at engine deceleration, the respective predetermined positions $PS_{WOT}$, $PS_{IDL}$, $PS_{DEC}$ for the pulse motor 13 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 20 performs selectively feedback control based upon proportional term correction (hereinafter called "P term control") and feedback control based upon integral term correction (hereinafter called "I term control"), in response to the engine rpm Ne detected by the engine rpm sensor 35, 36 and the output signal of the $O_2$ sensor 38. To be concrete, the integral term correction is used when the output voltage of the $O_2$ sensor 28 varies only at the higher level side or only at the lower level side with respect to a reference voltage Vref, wherein the position of the pulse motor 13 is corrected by an integral value obtained by integrating the value of a binary signal which changes in dependence on whether the output voltage of the $O_2$ sensor is at the higher level or at the lower level with respect to the predetermined reference voltage Vref, to thereby achieve stable and accurate position control of the pulse motor 13. On the other hand, when the output signal of the $O_2$ sensor changes from the higher level to the lower level or vice versa, the proportional term correction is carried out wherein the position of the pulse motor 13 is corrected by a value directly proportional to a change in the output voltage of the $O_2$ sensor to thereby achieve air/fuel ratio control in a manner prompter and more efficient than the integral term correction.

As noted above, according to the above I term control, the pulse motor position is varied by an integral value by integrating the value of a binary signal corresponding to the change of the output voltage of the $O_2$ sensor. According to this I term control, the number of steps by which the pulse motor is to be displaced per second differs depending upon the speed at which the engine is then operating. That is, in a low engine rpm range, the number of steps by which the pulse motor is to be displaced is small. With an increase in the engine rpm, the above number of steps increases so that it is large in a high engine rpm range.

Whilst, according to the P term control which, as noted above, is used when there is a change in the output voltage of the $O_2$ sensor from the higher level to the lower one or vice versa with respect to the reference voltage Vref, the number of steps by which the pulse motor is to be displaced per second is set at a single predetermined value (e.g., 6 steps), irrespective of the engine rpm.

The air/fuel ratio control at engine acceleration (i.e., off-idle acceleration) is carried out when the engine rpm Ne exceeds the aforementioned predetermined idle rpm $N_{IDL}$ (e.g., 1,000 rpm) during the course of the engine speed increasing from a low rpm range to a high rpm range, that is, when the engine speed changes from a relationship $Ne < N_{IDL}$ to one $Ne \geqq N_{IDL}$. On this occasion, ECU 20 rapidly moves the pulse motor 13 to a predetermined acceleration position (preset position) $PS_{ACC}$, and thereafter initiates the aforementioned air/fuel ratio feedback control. This predetermined position $PS_{ACC}$ is compensated for atmospheric pressure $P_A$, too, as hereinlater described.

The above-mentioned predetermined position $PS_{ACC}$ is set at a position where the amount of detrimental ingredients in the exhaust gases is small. Therefore, particularly at the so-called "standing start", i.e., acceleration from a vehicle-stopping position, setting the pulse motor position to the predetermined position $PS_{ACC}$ is advantageous to antiexhaust measures, as well as to achievement of accurate air/fuel ratio feedback control to be done following the acceleration. This acceleration control is carried out under a warmed-up engine condition, too. By thus setting the pulse motor to the preset position $PS_{ACC}$ at the standing start of the engine, it is feasible to reduce the amount of detrimental ingredients in the engine exhaust gases to be produced at the standing start. Further, this setting of the pulse motor position automatically determines the initial air/fuel ratio to be applied at the start of air/fuel ratio feedback control immediately following this standing start to thereby facilitate control of the air/fuel ratio to an optimum value for the emission characteristics and driveability of the engine at the start of air/fuel ratio feedback control.

Particularly, the above manner of control at engine acceleration enables a large reduction in the total amount of detrimental ingredients in the exhaust gases to be produced during transition from the standing start to the immediately following air/furl ratio feedback operation, thus being advantageous to the anti-pollution measures.

In transition from the above-mentioned various open loop control to the closed loop control at engine partial load or vice versa, changeover between open loop mode and closed loop mode is effected in the following manner: First, in changing from closed loop mode to open loop mode, ECU 20 moves the pulse motor 13 to an atmospheric pressure-compensated predetermined position $PSi(P_A)$ in a manner referred to later, irrespective of the position at which the pulse motor was located immediately before entering the open loop control. This predetermined position $PSi(P_A)$ includes preset positions $PS_{CR}$, $PS_{WOT}$, $PS_{IDL}$, $PS_{DEC}$ and $PS_{ACC}$, each of which is corrected in response to actual atmospheric pressure as hereinlater referred to. Various open loop control operations can be promptly done, simply by setting the pulse motor to the above-mentioned respective predetermined positions.

On the other hand, in changing from open loop mode to closed loop mode, ECU 20 commands the pulse motor 13 to initiate air/fuel ratio feedback control with I term correction. That is, there can be a difference in timing between the change of the output signal level of the $O_2$ sensor from the high level to the low level or vice versa and the change from the open loop mode to the closed loop mode. In such an event, the deviation of the pulse motor position from the proper position upon entering the closed loop mode, which is due to such timing difference, is much smaller in the case of initiating air/fuel ratio control with I term correction than that in the case of initiating it with P term correction, to make it possible to resume early accurate air/fuel ratio control and accordingly ensure highly stable engine exhaust emission characteristics.

To obtain optimum exhaust emission characteristics irrespective of changes in the actual atmospheric pressure during open loop air/fuel ratio control or at the time of shifting from open loop mode to closed loop mode, the position of the pulse motor 13 needs to be compensated for atmospheric pressure, as previously mentioned. According to the invention, the above-mentioned predetermined or preset positions $PS_{CR}$, $PS_{WOT}$, $PS_{IDL}$, $PS_{DEC}$, $PS_{ACC}$ at which the pulse motor 13 is to be held during the respective open loop control operations are corrected in a linear manner as a function of changes in the atmospheric pressure $P_A$, using the following equation:

$$PSi(P_A) = PSi + (760 - P_A) \times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 20.

ECU 20 applies to the above equation the coefficients PSi, Ci which are determined at proper different values according to the kinds of open loop control to be carried out, to calculate by the above equation the position $PSi(P_A)$ for the pulse motor 13 to be set at a required kind of open loop control and moves the pulse motor 13 to the calculated position $PSi(P_A)$, as will be described in detail hereinlater.

By correcting the air/fuel ratio during open loop control in response to the actual atmospheric pressure in the above-mentioned manner, it is possible to obtain not only conventionally known effects such as best driveability and prevention of burning of the ignition plug in an engine cylinder, but also optimum emission characteristics by setting the value of CI at a suitable value, since the pulse motor position held during open loop control forms an initial position upon entering subsequent closed loop control.

The position of the pulse motor 13 which is used as the actuator for the air/fuel ratio control valve 9 is monitored by a position counter provided within ECU 20. However, there can occur a disagreement between the counted value of the position counter and the actual position of the pulse motor due to skipping or racing of the pulse motor. In such an event, ECU 20 operates on the counted value of the position counter as if it were the actual position of the pulse motor 13. However, this can impede proper setting of the air/fuel ratio during open loop control where the actual position of the pulse motor 13 must be accurately recognized by ECU 20.

In view of the above disadvantage, as previously mentioned, according to the air/fuel ratio control system of the invention, in addition to detection of the initial position of the pulse motor 13 by regarding as the reference position (e.g., 50th step) the position of the pulse motor at which the reed switch 23 turns on or off when the pulse motor is driven, which was previously noted with reference to the initialization, the position counter has its counted value replaced by the number of steps corresponding to the reference position (e.g., 50 steps) stored in ECU 20 upon the pulse motor 13 passing the switching point of the reed switch 23, to thus ensure high reliability of subsequent air/fuel ratio control.

Figure 2:
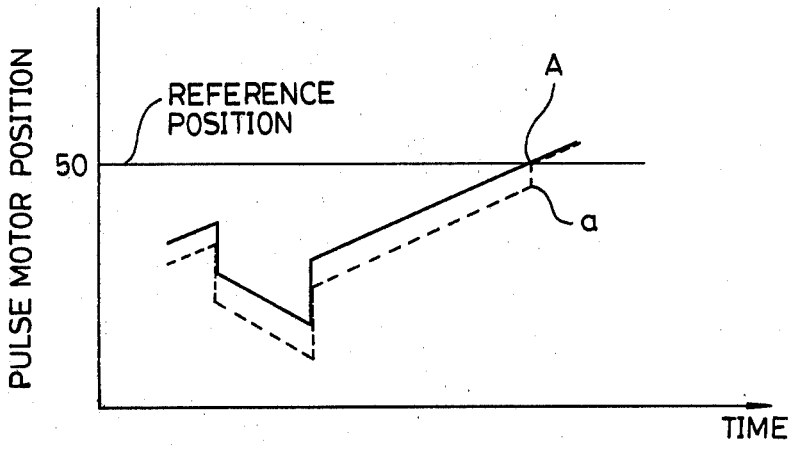
FIG. 2 is a graph showing the relationship between the position of the pulse motor in FIG. 1 and a count in the actual position counter in the electronic control unit of the system of FIG. 1.

For instance, as shown in FIG. 2, a phenomenon can occur that while the pulse motor is driven along the solid line under I term control and P term control, an actual pulse motor position counter in ECU 20 shows a count which is deviated from the actual or real position of the pulse motor as indicated by the broken line due to skipping or racing of the pulse motor as mentioned above. To make up for this deviation, according to the invention, when the pulse motor passes the reference position (50th step) at a time A for instance, this passage of the pulse motor by the reference position is detected through turning-on or -off of the reed switch 23 to replace the count a then obtained by the counter with a value (50 steps) corresponding to the reference position.

Figure 3:
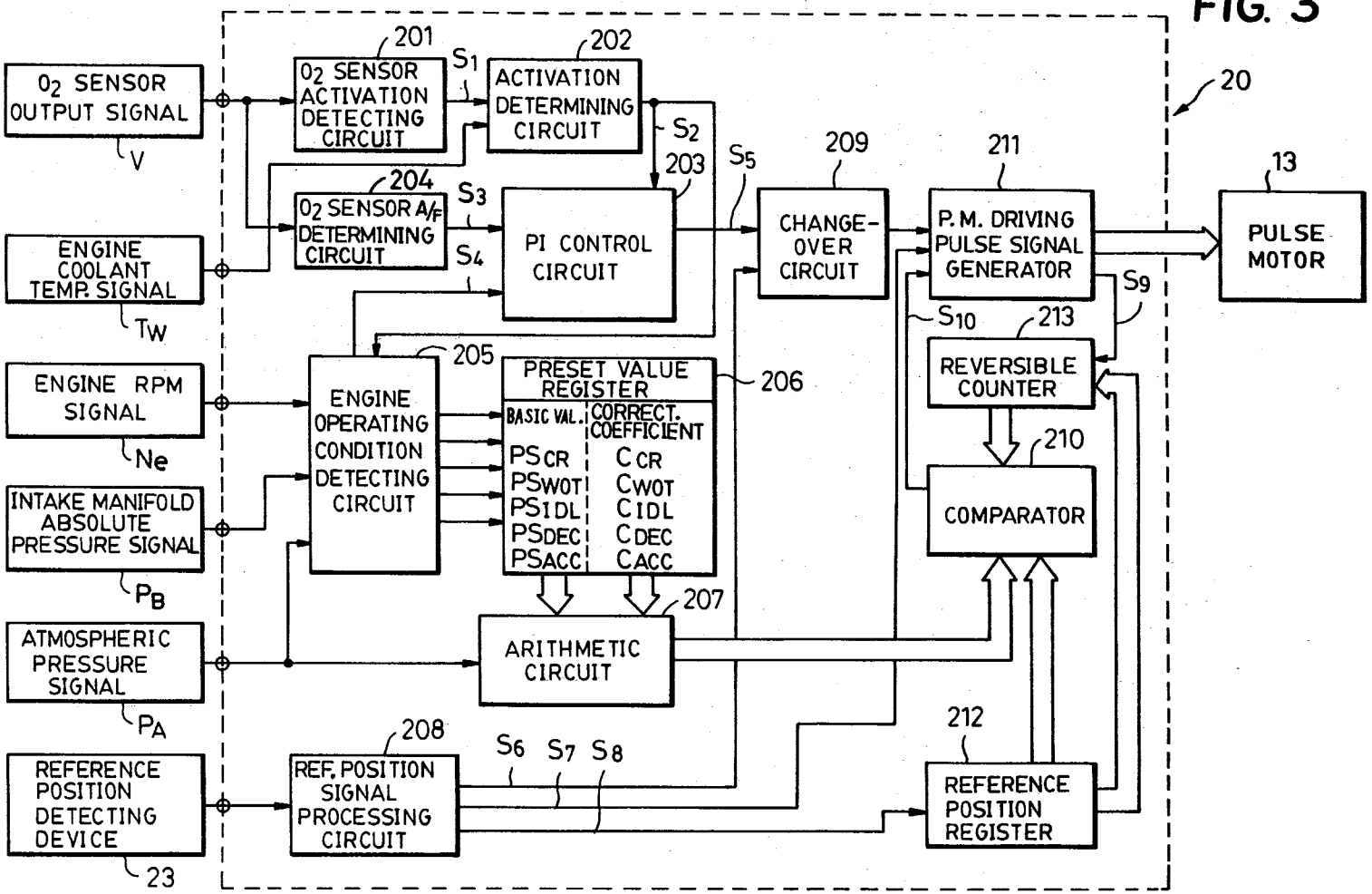
FIG. 3 is a block diagram illustrating as a whole an electrical circuit in the electronic control unit in FIG. 1.

FIG. 3 is a block diagram illustrating the interior construction of ECU 20 used in the air/fuel ratio control system having the above-mentioned functions according to the invention. In ECU 20, reference numeral 201 designates a circuit for detecting the activation of the $O_2$ sensor 28, which is supplied at its input with an output signal V from the $O_2$ sensor. Upon passage of the predetermined period of time Tx after the voltage of the above output signal V has dropped below the predetermined value Vx, the above circuit 201 supplies an activation signal $S_1$ to an activation determining circuit 202. This activation determining circuit 202 is also supplied at its input with an engine coolant temperature signal Tw from the thermistor 33 in FIG. 1. When supplied with both the above activation signal $S_1$ and the coolant temperature signal Tw indicative of a value exceeding the predetermined value Twx, the activation determining circuit 202 supplies an air/fuel ratio control initiation signal $S_2$ to a PI control circuit 203 to render same ready to operate. Reference numeral 204 represents an air/fuel determining circuit which determines the value of air/fuel ratio of engine exhaust gas, depending upon whether or not the output voltage of the $O_2$ sensor is larger than the predetermined value Vref, to supply a binary signal $S_3$ indicative of the value of air/fuel ratio thus obtained, to the PI control circuit 203. On the other hand, an engine condition detecting circuit 205 is provided in ECU 20, which is supplied with an engine rpm signal Ne from the engine rpm sensor 35, 36, an absolute pressure signal $P_B$ from the pressure sensor 31, an atmospheric pressure signal $P_A$ from the atmospheric pressure sensor 29, all the sensors being shown in FIG. 1, and the above control initiation signal $S_2$ from the activation determining circuit 202 in FIG. 3, respectively. The circuit 205 supplies a control signal $S_4$ indicative of a value corresponding to the values of the above input signals to the PI control circuit 203. The PI control circuit 203 accordingly supplies to a change-over circuit 209 to be referred to later a pulse motor control signal $S_5$ having a value corresponding to the air/fuel ratio signal $S_3$ from the air/fuel ratio determining circuit 204 and a signal component corresponding to the engine rpm Ne in the control signal $S_4$ supplied from the engine condition detecting circuit 205. The engine condition detecting circuit 205 also supplies to the PI control circuit 203 the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine condition detecting circuit 205, the PI control circuit 203 interrupts its own operation. Upon interruption of the supply of the above signal component to the control circuit 203, a pulse signal $S_5$ is outputted from the circuit 203 to the change-over circuit 209, which signal starts air/fuel ratio control with integral term correction.

On the other hand, a preset value register 206 is provided in ECU 20, in which are stored the basic values of preset values $PS_{CR}$, $PS_{WOT}$, $PS_{IDL}$, $PS_{DEC}$ and $PS_{ACC}$ for the pulse motor position, applicable to various engine conditions, and atmospheric pressure correcting coefficients $C_{CR}$, $C_{WOT}$, $C_{IDL}$, $C_{DEC}$ and $C_{ACC}$ for these basic values. The engine condition detecting circuit 205 detects the operating condition of the engine based upon the activation of the $O_2$ sensor and the values of engine rpm Ne, intake manifold absolute pressure $P_B$ and atmospheric pressure $P_A$ to read from the register 206 the basic value of a preset value corresponding to the detected operating condition of the engine and its corresponding correcting coefficient and apply same to an arithmetic circuit 207. The arithmetic circuit 207 performs arithmetic operation responsive to the value of the atmospheric pressure signal $P_A$, using the equation $PSi(P_A)=PSi+(760-P_A)\times Ci$. The resulting preset value is applied to a comparator 210.

On the other hand, a reference position signal processing circuit 208 is provided in ECU 20, which is responsive to the output signal of the reference position detecting device (reed switch) 23, indicative of the switching of same, to produce a binary signal $S_6$ having a certain level from the start of the engine until it is detected that the pulse motor reaches the reference position. This binary signal $S_6$ is supplied to the change-over circuit 209 which in turn keeps the control signal $S_5$ from being transmitted from the PI control circuit 203 to a pulse motor driving signal generator 211 as long as it is supplied with this binary signal $S_6$, thus avoiding the interference of the operation of setting the pulse motor to the initial position with the operation of P-term/I-term control. The reference position signal processing circuit 208 also produces a pulse signal $S_7$ in response to the output signal of the reference position detecting device 23, which signal causes the pulse motor 13 to be driven in the step-increasing direction or in the step-decreasing direction so as to detect the reference position of the pulse motor 13. This signal $S_7$ is supplied directly to the pulse motor driving signal generator 211 to cause same to drive the pulse motor 13 until the reference position is detected. The reference position signal processing circuit 208 produces another pulse signal $S_8$ each time the reference position is detected. This pulse signal $S_8$ is supplied to a reference position register 212 in which the value of the reference position (e.g., 50 steps) is stored. This register 212 is responsive to the above signal $S_8$ to apply its stored value to one input terminal of the comparator 210 and to the input of a reversible counter 213. The reversible counter 213 is also supplied with an output pulse signal $S_9$ produced by the pulse motor driving signal generator 211 to count the pulses of the signal $S_9$ corresponding to the actual position of the pulse motor 13. When supplied with the stored value from the reference position register 212, the counter 213 has its counted value replaced by the value of the reference position of the pulse motor.

The counted value thus renewed is applied to the other intput terminal of the comparator 210. Since the comparator 210 has its other input terminal supplied with the same pulse motor reference position value, as noted above, no output signal is supplied from the comparator 210 to the pulse motor driving signal generator 211 to thereby hold the pulse motor at the reference position with certainty. Subsequently, when the $O_2$ sensor 28 remains deactivated, an atmospheric pressure-compensated preset value $PS_{CR(PA)}$ is outputted from the arithmetic circuit 207 to the one input terminal of the comparator 210 which in turn supplies an output signal $S_{10}$ corresponding to the difference between the preset value $PS_{CR}(P_A)$ and a counted value supplied from the reversible counter 213, to the pulse motor driving signal generator 211, to thereby achieve accurate control of the position of the pulse motor 13. Also, when the other open loop control conditions are detected by the engine condition detecting circuit 205, similar operation to that just mentioned above are carried out.

Figure 4:
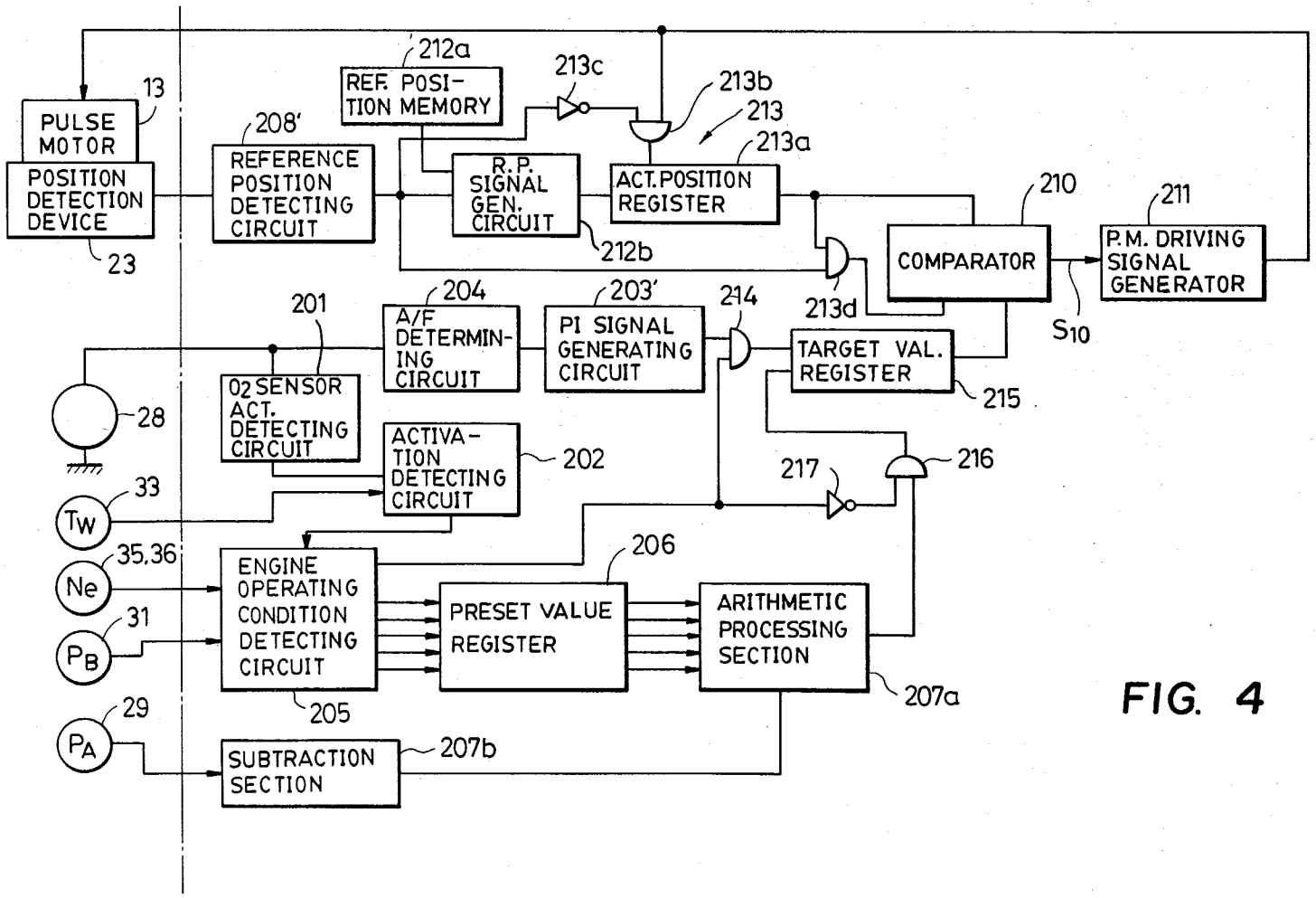
FIG. 4 is a circuit diagram illustrating an arrangement for detecting the reference position of the pulse motor to correct the count in the actual position counter.

Referring to FIG. 4, there is shown a circuit diagram of an arrangement provided in ECU 20 for detecting a passage of the pulse motor by its reference position and thereby correcting the count in the actual position counter in ECU 20 to the value corresponding to the reference position.

In ECU 20, a reference position detecting circuit 208' forming part of the reference position signal processing circuit 208 in FIG. 3 is connected at its input to a position detecting device (reed switch) 23 which is arranged to detect the position of the pulse motor 13. The detecting circuit 208' has its output connected to one input terminal of a reference position signal generating circuit **212*b* which is formed of a plurality of AND circuits arranged in parallel so as to produce a signal having a required number of bits. Connected to the other input terminal of the same circuit 212*b* is a reference position memory 212*a* which cooperates with the circuit 212*b* to form the reference position register 212 in FIG. 3 and stores a value corresponding to the reference position for the pulse motor 13. The circuit 212*b* is connected at its output to the input of a register 213*a* which stores the actual position of the pulse motor. This actual position register 213*a* has its output connected to one input terminal of the comparator 210 which in turn has its output connected to the pulse motor driving signal generator 211 as previously noted with reference to FIG. 3. The generator 211 has its output connected to the pulse motor 13 as well as to the actual position register 213*a* by way of an AND circuit 213*b*. The AND circuit 213*b* has its one input terminal connected to the output of the reference position detecting circuit 208' by way of an inverter 213*c*. An AND circuit 213*d* is connected at its one input terminal to the output of the actual position register 213*a*, its other input terminal to the output of the reference position detecting circuit 208', and its output to the other input terminal of the comparator 210, respectively. The above actual position register 213*a* forms the reversible counter 213 in FIG. 3 in cooperation with the AND circuit 213*b*, the inverter 213*c* and the AND circuit 213*d***.

On the other hand, the $O_2$ sensor air/fuel ratio determining circuit 204 is connected at its output to the input of a PI signal generating circuit 203' forming part of the PI control circuit 203 in FIG. 3. This circuit 203' has its output connected to the input of an AND circuit 214 to which is also connected the output of the engine operating condition detecting circuit 205. The latter circuit 205 is adapted to supply a binary signal of 0 to the AND circuit 214 under an open loop control condition. The AND circuit 214 has its output connected to the input of a target value register 215 for storing a target position value for the pulse motor, which register in turn has its output connected to the other input terminal of the comparator 210. Further connected to the input of this target value register 215 is the output of the arithmetic processing section **207*a* of the arithmetic circuit 207 in FIG. 3, by way of an AND circuit 216. Connected by way of an inverter 217 to the input terminal of the AND circuit 216 other than one connected to the arithmetic processing section 207*a* of the arithmetic circuit 207 is the output terminal of the engine operating condition detecting circuit 205 which is connected to the AND circuit 214. A subtraction section 207*b*, which forms, together with the arithmetic processing section 207*a*, the arithmetic circuit 207, is connected between the arithmetic processing section 207*a* and the atmospheric pressure sensor 29** to calculate the difference between an actual atmospheric pressure detected and a predetermined atmospheric pressure (e.g., 760 mmHg).

Incidentally, in FIG. 4, the $O_2$ sensor activation detecting circuit 201, the $O_2$ sensor activation determining circuit 202, the $O_2$ sensor air/fuel ratio determining circuit 204, the engine operating condition detecting circuit 205, the preset value register 206, etc. shown in FIG. 3 are arranged in a manner similar to that in FIG. 3, description of which is therefore omitted here.

The operation of the arrangement of FIG. 4 described above will now be described. As previously mentioned, the pulse motor 13 is driven by a driving signal produced by the pulse motor driving signal generator 211. This driving signal is also supplied to the actual position register 213*a*, too, through the AND circuit 213*b* so that the contents stored in the actual position register 213*a* corresponds to the actual position of the pulse motor 13 which is based upon the driving signal. When the pulse motor 13 passes the reference position (50th step), the reference position detecting device 23 in turned on or off, in response to which the reference position detecting circuit 208′ applies a binary output of 1 to one input terminal of the reference position pulse signal generating circuit 212*b*. At the same time, the above ginary output of 1 is applied to the AND circuit 213b via the inverter 213*c* to cause interruption of the supply of the driving signal from the AND circuit 213*b* to the actual position register 213*a*. Then, the generating circuit 212*b* has its outer input terminal supplied with a reference position signal from the reference position memory 212*a*, to supply a signal corresponding in value to the reference position for the pulse motor 13 to the actual position register 213*a* to have the value stored in the latter replaced by a value corresponding to the reference position. In this manner, correction of the value stored in the reversible counter 213 in ECU 20 is carried out in response to the actual position of the pulse motor 13. On this occasion, as previously mentioned with reference to FIG. 3, the value (reference position) in the actual position register 213*a* thus renewed is applied to one input terminal of the comparator 210 at the time of detection of the reference position of the pulse motor 13. Simultaneously, the same value in the register 213*a* is also applied to the other input terminal of the comparator 210 via the AND circuit 213*d* which has its one input terminal supplied with a binary signal of 1 from the reference position detecting circuit 208′ at the time of detection of the reference position. Therefore, no output signal $S_{10}$ is produced from the comparator 210 so that the pulse motor 13 is held at the reference position without fail. Thus, after the pulse motor passes the reference position, the value stored in the actual position register 213*a* exactly corresponds to the actual position of the pulse motor 13.

On the other hand, during air/fuel feedback control in closed loop mode, the PI signal generating circuit 203′ supplies a pulse motor control signal to the target value register 215 via the AND circuit 214 to carry out P term control or I term control in response to the signal outputted from the $O_2$ sensor air/fuel ratio determining circuit 204. The comparator 210 compares the value supplied from the target value register 215 with a value supplied from the actual position register 213*a* to supply an output signal $S_{10}$ indicative of the difference between the two values to the pulse motor driving signal generator 211 to cause it to drive the pulse motor 13 until the value counted by the actual position becomes equal to the value supplied from the target value register 215. When an open loop control condition stands, the engine operating condition detecting circuit 205 is responsive to the output signals of the $O_2$ sensor activation determining circuit 202, the pressure sensor 31, the engine rpm sensor 35, 36 and the atmospheric pressure sensor 29, to detect the fulfillment of this open loop control condition and supply a binary signal of 0 to the AND circuit 214 to cause interruption of the supply of the pulse motor control signal from the PI signal generating circuit 203′ to the target value register 215. At the same time, this binary signal of 0 is turned over by the inverter 217 so that the AND circuit 216 is supplied at its one input terminal with an input of 1. On this occasion, as previously noted with reference to FIG. 3, the engine operating condition detecting circuit 205 selectively shifts a preset value and a correction coefficient, which corresponds to the engine operating condition concerned, from the preset value register 206 to the arithmetic processing section 207*a*. This section 207*a* then arithmetically calculates a target position for the pulse motor on the basis of a signal from the subtraction section 207*b* indicative of the difference between an actual atmospheric pressure detected and the predetermined value (760 mmHg), and applies a signal corresponding to the target position to the target value register 215 via the AND circuit 216. While the AND circuit 216 has its one input terminal supplied with the above input of 1 as previously noted, the above signal outputted from the arithmetic processing section 207*a* is continuously supplied to the target value register 215.

As noted above, during fulfillment of an open loop control condition, the comparator 210 has its one input terminal supplied with a value from the actual position register 213*a*, which exactly corresponds to the actual position of the pulse motor due to the renewal of the same value at the time of detection of the reference position, and its other input terminal with a pulse motor target value (compensated for atmospheric pressure) from the target value register 215 appropriate for the open loop control condition concerned, respectively, to supply an output signal $S_{10}$ corresponding in value to the difference between the two input values to the pulse motor driving generator 211 which in turn drives the pulse motor 13 by its output driving signal based upon the output signal $S_{10}$ until the value in the actual position register 213*a* becomes equal to the value in the target value register 215.

What is claimed is:

1. In an air/fuel ratio feedback control system for performing feedback control of the air/fuel ratio of an air/fuel mixture being supplied to an internal combustion engine, which includes means for detecting the concentration of an exhaust gas ingredient emitted from the engine, fuel quantity adjusting means for producing the mixture being supplied to said engine, means operatively connecting said concentration detecting means with said fuel quantity adjusting means in a manner effecting feedback control operation to control the air/fuel ratio of said mixture to be a predetermined value, said connecting means comprising an electrical circuit, valve means for varying the air/fuel ratio of said mixture, and a pulse motor arranged to be controlled by said electrical circuit for driving said valve means, the combination comprising position detecting means for producing an output when said pulse motor is at a predetermined reference position which is set within a movable range of said pulse motor, a memory storing a value indicative of said predetermined reference position for said pulse motor, a first register responsive to an output signal of said concentration detecting means, indicative of the concentration of said exhaust gas ingredient, to make accessible a predetermined desired value for said pulse motor, a second register storing a value indicative of an actual position of said pulse motor, means for driving said pulse motor until said actual position value in said second register becomes equal to said predetermined desired value, and means responsive to said output of said position detecting means to cause shifting of said predetermined reference position value stored in said memory to said second register to replace the value stored in the latter by said predetermined reference position value.

2. The combination according to claim 1, wherein said predetermined reference position of said pulse motor is an intermediate position set within the movable range of the pulse motor.

* * * * *